US007002615B2

(12) United States Patent
Shim

(10) Patent No.: US 7,002,615 B2
(45) Date of Patent: Feb. 21, 2006

(54) LASER BEAM ISOLATION APPARATUS OF A LASER PRINTER

(75) Inventor: Hyeong-seong Shim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/430,256

(22) Filed: May 7, 2003

(65) Prior Publication Data

US 2004/0008246 A1 Jan. 15, 2004

(30) Foreign Application Priority Data

Jul. 12, 2002 (KR) ..... 2002-40601

(51) Int. Cl.
*B41J 2/435* (2006.01)

(52) U.S. Cl. ..... 347/263

(58) Field of Classification Search ..... 347/228
See application file for complete search history.

(56) References Cited

U.S. PATENT DOCUMENTS 5,157,416 A 10/1992 Kinoshita et al.
2001/0021295 A1 9/2001 Yoshida
2002/0024585 A1 * 2/2002 Kim et al. ..... 347/228

FOREIGN PATENT DOCUMENTS

JP 3-2775 9/1991
JP 6-332083 2/1994

* cited by examiner

*Primary Examiner*—Huan Tran
(74) *Attorney, Agent, or Firm*—Staas & Halsey LLP

(57) ABSTRACT

A laser beam isolation apparatus of a laser printer includes a blocking portion formed on the laser scanning unit to be moved between a blocking position to block a passing hole of the laser scanning unit and an open position to open the passing hole, a guide portion mounted in the laser scanning unit relative to the blocking portion, guiding the blocking portion to move between the blocking position and the open position, and an operating portion formed on the developer unit. The operating portion is operated to move the blocking portion along the guide portion. During a removal of the developer unit, the blocking portion that blocks a laser beam of a laser diode from being emitted out of the laser scanning unit is moved to the blocking position by its own weight.

18 Claims, 7 Drawing Sheets

LASER BEAM ISOLATION APPARATUS OF A LASER PRINTER

CROSS-REFERENCE TO RELATED APPLICATIONS

This application claims the benefit of Korean Application No. 2002-40601, filed Jul. 12, 2002, in the Korean Intellectual Property Office, the disclosure of which is incorporated herein by reference.

BACKGROUND OF THE INVENTION

1. Field of the Invention

The present invention generally relates to a laser beam isolation apparatus of a laser printer, and more particularly, to a laser beam isolation apparatus of a laser printer which prevents a laser beam from being emitted out of a laser scanning unit (LSU) when the LSU erroneously operates in the absence of a developer unit of the laser printer due to abnormality of related parts.

2. Description of the Related Art

A general conventional printing apparatus, a laser printer in this instance (FIG. 1), includes a paper feeding portion 1 in which paper sheets are stacked, a paper conveying portion 2 to convey a paper sheet from the paper feeding portion 1, and a laser scanning unit (LSU) 4 to form an electrostatic latent image on a photoreceptor drum 3. The apparatus further includes a developer unit 6 to develop the electrostatic latent image on the photoreceptor drum 3 into a visible image with a supply of toner thereon and then forming, with the supply of a transfer voltage between a transfer roller 5 and the photoreceptor drum 3, a toner image on the paper sheet being conveyed by the paper conveying portion 2, a fusing portion 7 to fix the toner image on the paper sheet with heat and pressure, and a paper discharging portion 8 to discharge the paper sheet with the toner image fixed thereon.

Among the above parts of the printer, the LSU 4 functions to form an electrostatic latent image on the photoreceptor drum 3 in accordance with an image signal by irradiating a laser beam 11 onto the photoreceptor drum 3, and includes a laser diode 4*a* to emit the laser beam 11, a rotary polygon mirror to deflect and reflect the laser beam 11 from the laser diode 4*a* at a constant linear velocity, a scan lens 4*c* to compensate for an error included in the laser beam 11 reflected from the rotary polygon mirror 4*b*, and a reflective mirror 4*d* to reflect the laser beam 11 towards a surface of the photoreceptor drum 3. The laser beam 11 passes through a laser beam passing hole 4*e*.

Generally, the LSU 4 is provided above the developer unit 6 and emits a laser beam 11 onto the surface of the photoreceptor drum 3 via beam passing holes 4*f* of the developer unit 6. This construction causes undesirable exposure of the user to the laser beam 11 when he/she replaces an old developer unit 6, or removes the developer unit 6 to check a paper jam.

In order to protect the user from a possible exposure to the laser beam, conventionally, the printer was provided with a laser beam isolation switch 10 as shown in FIGS. 2A and 2B, which cuts off the power supply of the laser diode 4*a* upon opening the cover 20 relative to the hinge axis 20*a* for repair, replacement, or the like.

The laser beam isolation switch 10 includes a switch 23 formed in a housing 14 and connected to the power supply for the LSU 4, a switch operating member 60 formed in the housing 14 and operating the switch 23 in accordance with the opening and closing of the cover 20, and a projection 50 formed on the cover 20 and movable in association with the switch operating member 60 to operate the switch 23 by pressing the switch 23. The switch operating member 60 includes an operating portion 61 contacting the projection 50, a switch contacting portion 63 formed at a predetermined angle relative to the operating portion 61 to operate the switch 23 by contact, a hinge portion 62 arranged between the operating portion 61 and the contacting portion 63 to guide the rotational movement of the switch operating member 60, and a spring 64 disposed on the housing 14 to elastically pull the switch contacting portion 63.

Describing the operation of the conventional laser beam isolation switch 10 in detail, first, with the closing of the cover 20 as shown in FIG. 2A, the operating portion 61 of the switch operating member 60 is pressed downwards by the projection 50. Accordingly, the switch contacting portion 63 of the switch operating member 60 is rotated about the hinge portion 62 counterclockwise against the recovering force of the spring 64, thereby pressing the switch 23. As a result, the laser diode 4*a* is operated normally, and emits laser beam 11.

Next, with the opening of the cover 20, the projection 50 is spaced apart from the operating portion 61, followed by the switch contacting portion 63 rotated by the recovery force of the spring 64 about the hinge portion 62 clockwise to subsequently release the switch 23. As a result, operation of the laser diode is stopped, and the laser beam 11 is not released.

However, with the conventional laser beam isolation switch 10 as described above, the operation of the laser diode 4*a* is not stopped if the cover 20 is opened for the developer unit 6 replacement with the switch 23 not being operated due to an internal short circuit. As a result, the user is exposed to the laser beam emitted from the LSU 4. Exposure to the LSU 4 can be dangerous especially if the laser beam 11 is directly emitted from the LSU 4 to parts of the body, such as an eye, when the user opens the cover 20 and removes the developer unit 6.

In an attempt to solve the above problems, a laser printer having a laser beam isolation apparatus 51 as shown in FIGS. 3A and 3B, which covers a laser beam passing hole 4*e*40 of the LSU 4' so as to block the laser beam 11' that can be irradiated from the LSU 4' during a removal of the developer unit 6'.

As shown in FIG. 3A, the laser beam isolation apparatus 51 of the laser printer includes a blocking plate 52 in a flattened U-shape movably secured to the axis 54 with one end and the other end to pivot to open and close the laser beam passing hole 4*e'* formed at a lower side of the housing of the LSU 4', an elastic spring 53 disposed between the housing of the LSU 4 and the blocking plate 52 to elastically support the blocking plate 52 to the blocking position (see FIG. 3B) where the blocking plate 52 blocks the laser beam passing hole 4*e'*, and an operation projection 55 to maintain the blocking plate 52 at an opening position where the blocking plate 52 opens the laser beam passing hole 4*e'* during a mounting of the developer unit 6'.

With the developer unit 6' being mounted under the LSU 4' as shown in FIG. 3A, the operation projection 55 of the developer unit 6' pushes the blocking plate 52 towards the opening position. Accordingly, the laser beam 11' is emitted from the LSU 4' onto the photoreceptor drum 3' through the laser beam passing hole 4*e'* of the LSU 4' and through the passing hole 4*f'* of the developer unit 6'.

Then, with the cover 20' being opened and the developer unit 6' being removed from the LSU 4' as shown in FIG. 3B, the blocking plate 52 is returned to the blocking position by the recovering force of the elastic spring 53. Accordingly, the blocking plate 52 is moved to close the laser beam passing hole 4*e'* formed at a lower side of the LSU 4' by the recovering force of the elastic spring 53. The laser beam 11' from the LSU 4' is reflected inwards of the housing of the LSU 4' from the lower side 52' of the blocking plate 52, and thus, the user is not exposed to the laser beam 11'.

While the conventional laser beam isolation apparatus 51 effectively blocks the laser beam 11' of the laser diode (not shown) from being emitted outside of the LSU 4' due to abnormality of the related parts during removal of the developer unit 6', the structure of the blocking plate 52 requires the employment of the elastic spring 53 to move the blocking plate 52 to the blocking position. As additional elastic springs 53 are required to move the blocking plate 52 to the blocking position, the structure of the laser beam isolation apparatus 51 becomes complex, and manufacture costs increase.

Further, in the conventional laser beam isolation apparatus 51, foreign substances such as dust sometimes enter into the interior of the LSU 4' through the laser beam passing hole 4*e'* with the movement of the blocking plate 52 to the blocking position, thus deteriorating the performance of the LSU 4'.

In order to prevent entrance of foreign substances through the laser beam passing hole 4*e'*, the laser beam passing hole 4*e'* may be sealed by a transparent glass. However, this has a drawback of high manufacturing cost due to employment of additional parts, i.e., the transparent glass.

SUMMARY OF THE INVENTION

Accordingly, it is an aspect of the present invention to provide a laser beam isolation apparatus of a laser printer capable of not only preventing a laser beam from being emitted out of a laser scanning unit (LSU) due to abnormal operation of the laser diode of the LSU during a removal of a developer unit for repair or replacement, or when a cover is opened with the developer unit not being mounted in place, but also preventing foreign substances from entering into the LSU through a passing hole.

It is another aspect of the present invention to provide a laser beam isolation apparatus of a laser printer having a simple structure and requiring lower manufacturing costs, which has a blocking portion to block a laser beam from being emitted to the outside while being operated by its own weight, thus requiring no elastic spring as an essential part.

Additional aspects and advantages of the invention will be set forth in part in the description which follows and, in part, will be obvious from the description, or may be learned by practice of the invention.

The foregoing and/or additional aspects are achieved by providing a laser beam isolation apparatus of a laser printer having a housing having a cover, a developer unit mounted in the housing and having a photoreceptor body to form an image by using an electric property of a surface thereof, a laser scanning unit mounted in the housing and comprising a light source to irradiate a laser beam onto the photoreceptor, and a passing hole through which the laser beam is emitted from the light source toward the surface of the photoreceptor body, including a blocking portion formed on the laser scanning unit to be moved between a blocking position and an opening position, the blocking position to block the passing hole and the opening position to open the passing hole; and an operating portion formed on the developer unit, and operated to move the blocking portion in a first direction.

The laser beam blocking unit may include a blocking portion formed on the laser scanning unit to be moved between a blocking position and an opening position, the blocking position to block the passing hole and the opening position to open the passing hole, a guide portion mounted in the laser scanning unit relative to the blocking portion, guiding the blocking portion to move between the blocking position and the opening position, and an operating portion formed on the developer unit, and operated to move the blocking portion upwards along the guide portion.

The blocking portion includes an elongated passing hole blocking plate formed in a shape that completely seals the passing hole of the laser scanning unit in the blocking position, and one or more projection levers protruding downwards from the elongated passing hole blocking plate.

The guide portion includes one or more inclined sliders formed on the elongated passing hole blocking plate, and one or more inclined slider guides having an inclined passage to receive the inclined sliders therein and guide the elongated passing hole blocking plate to move at a predetermined slope. Alternatively, the inclined slider guides include a stopper to limit the movement of the elongated passing hole blocking plate within a predetermined range thereby preventing a deviation of the elongated passing hole blocking plate from the inclined passage.

The operating portion includes an operating projection formed on the developer unit in correspondence with the projection lever to push the projection lever upwards and thus move the blocking portion to the opening position upon mounting the developer unit. Each of the projection lever and the operating projection includes a rounded contact surface for a smooth contact of the projection lever and the operating projection.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
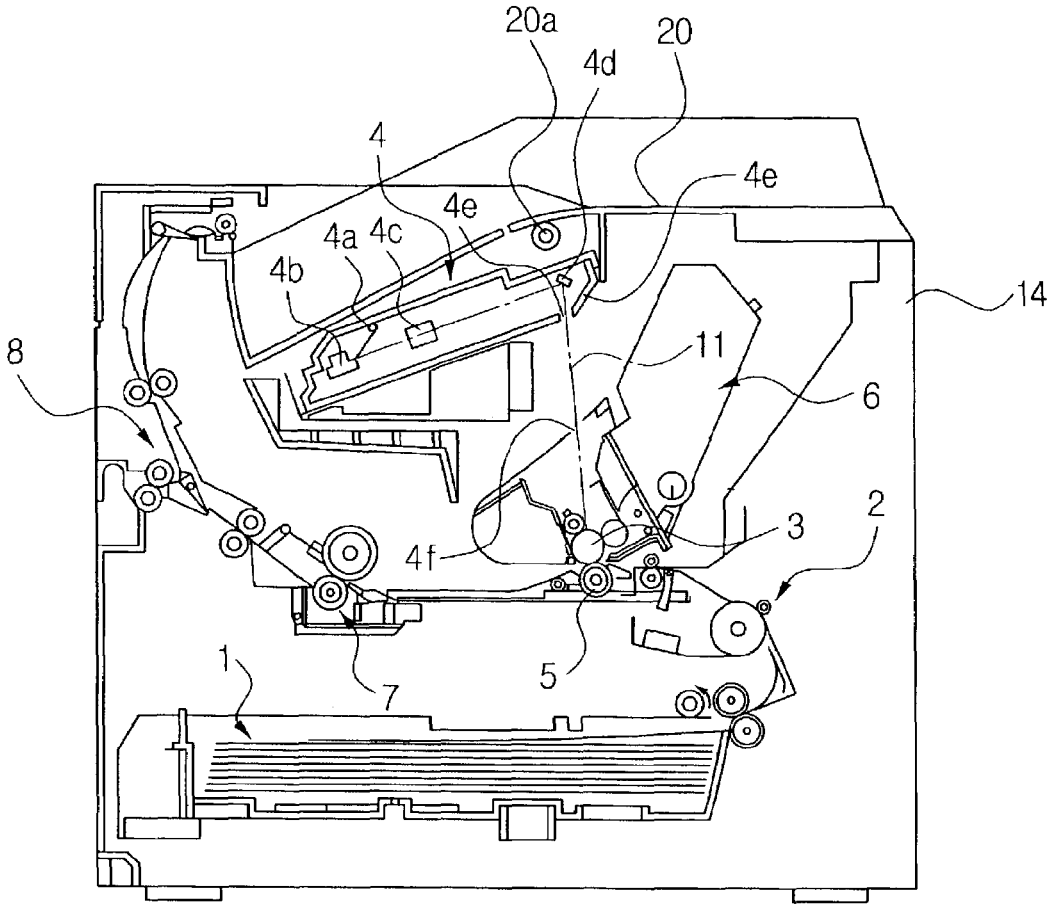
FIG. 1 (PRIOR ART)
FIG. 1 is a schematic view of a conventional laser printer.
Figure 2A:
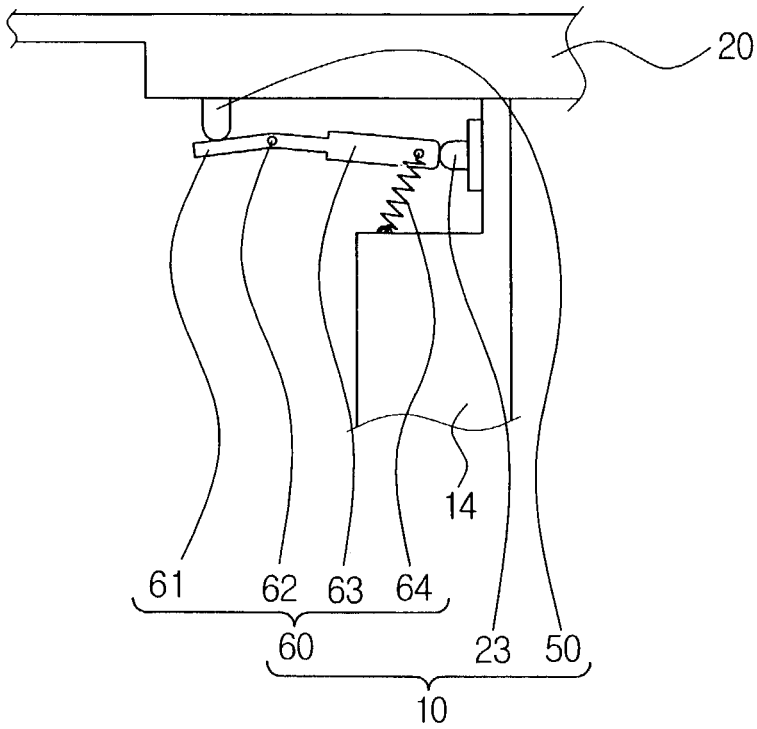
FIG.2A (PRIOR ART)
FIGS. 2A and 2B are partial sectional views illustrating an operation of the conventional laser beam isolation apparatus of FIG. 1.
Figure 2B:
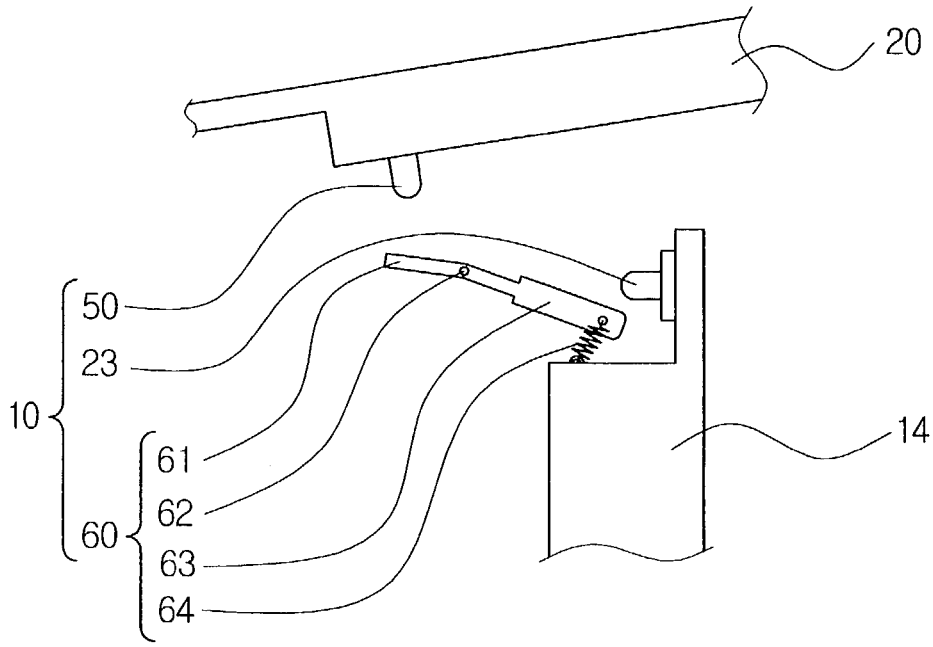
FIG.2B (PRIOR ART)
Figure 3A:
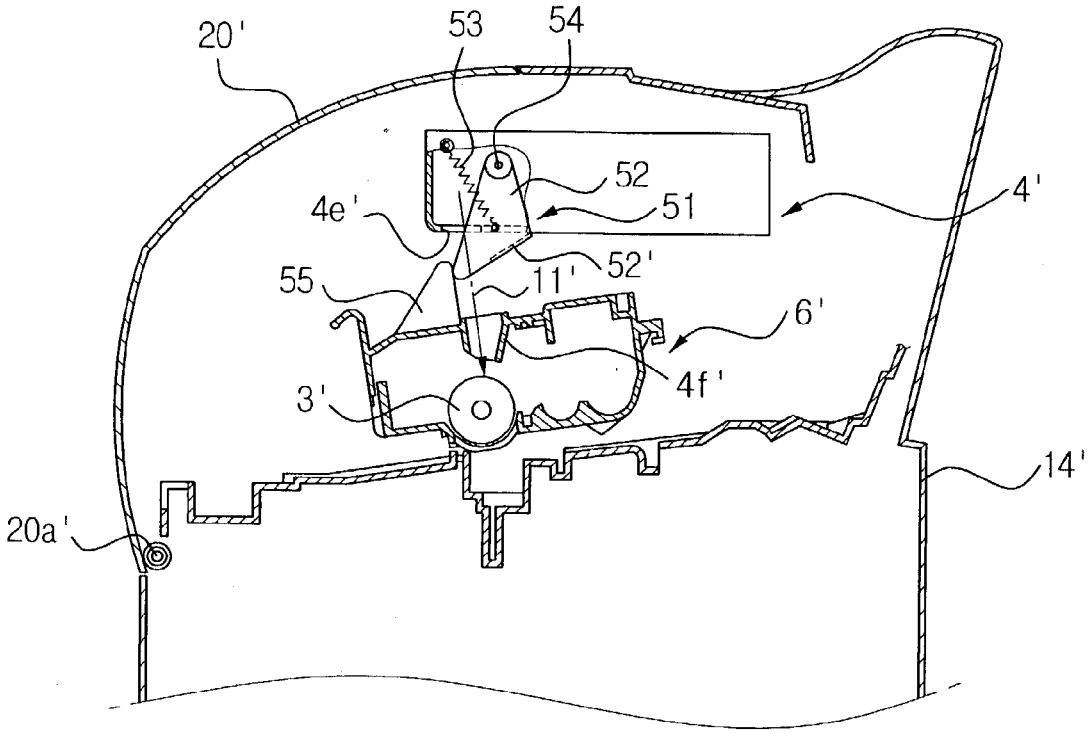
FIG.3A (PRIOR ART)
FIGS. 3A and 3B are partial sectional views illustrating an operation of the conventional laser beam isolation apparatus of FIG. 1.
Figure 3B:
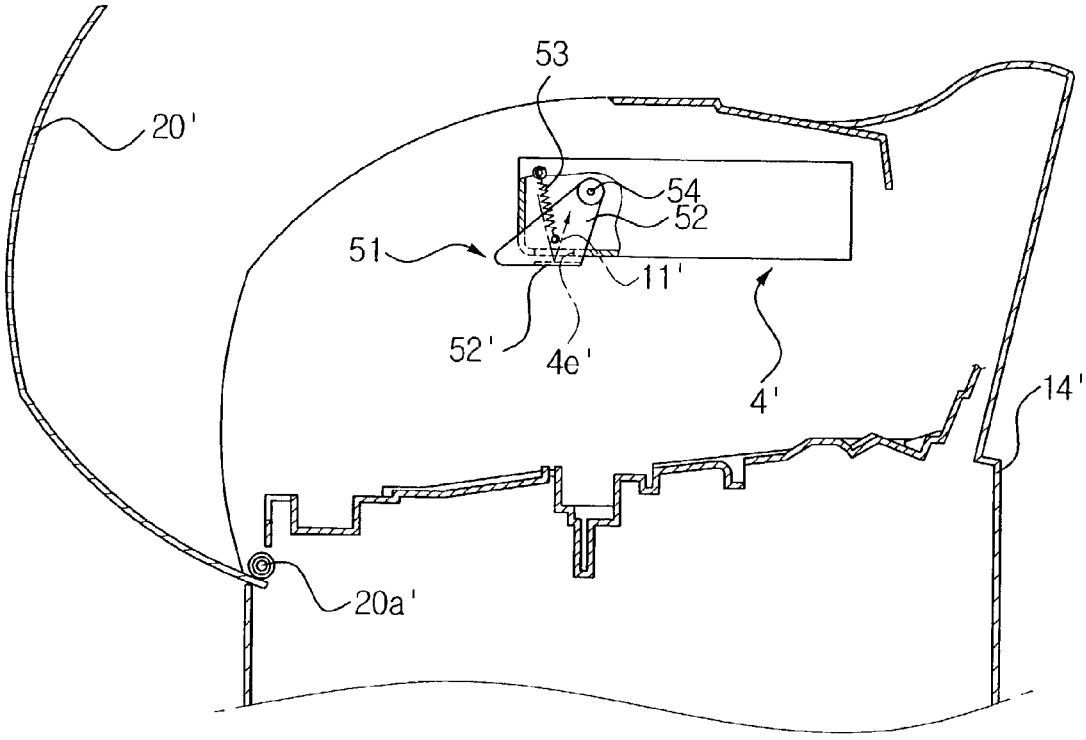
FIG.3B (PRIOR ART)

Reference will now be made in detail to the present preferred embodiment of the present invention, an example of which is illustrated in the accompanying drawings, wherein like reference numerals refer to like elements throughout.

Figure 5A:
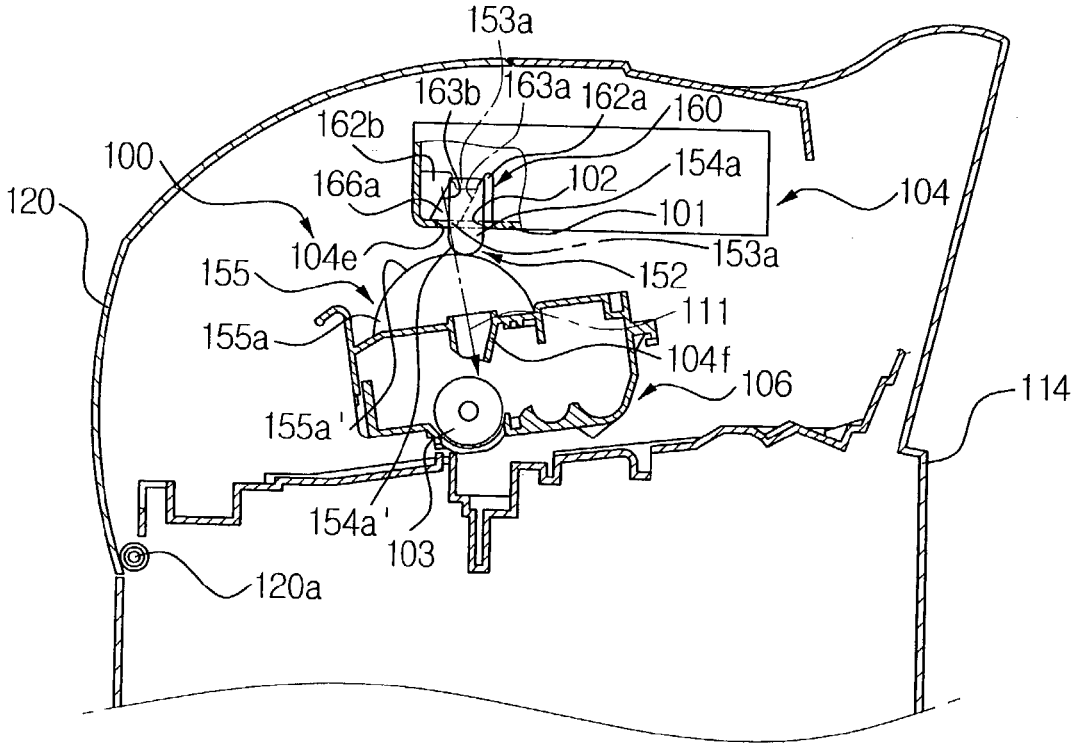
FIGS. 5A and 5B are partial sectional views illustrating an operation of the laser beam isolation apparatus of FIG. 4.

Referring to FIG. 5A, the laser printer having a laser beam isolation apparatus 100 according to an embodiment of the present invention includes a housing 114 having a cover 120 movably secured to a hinge axis 120*a* so as to be pivoted thereon, a developer unit 106 mounted in the housing 114 and including a photoreceptor drum 103 to form an image thereon by using an electrical property thereof, and a laser scanning unit 104 to irradiate a laser beam 111 onto a surface of the photoreceptor drum 103.

The LSU 104 includes a laser diode (not shown) mounted in a housing 114 to emit the laser beam 111, a rotary polygon mirror (not shown) to deflect and reflect the laser beam 111 from the laser diode at a constant linear velocity, a scan lens (not shown) to compensate for the error included in the laser beam 111 reflected from the rotary polygon mirror, a reflective mirror (not shown) to reflect the laser beam 111 onto the surface of the photoreceptor drum 103 via a passing hole 104*f*, and a housing 101 having a passing hole 104*e* formed therein through which the laser beam 111 reflected from the reflective mirror is passed.

Figure 4:
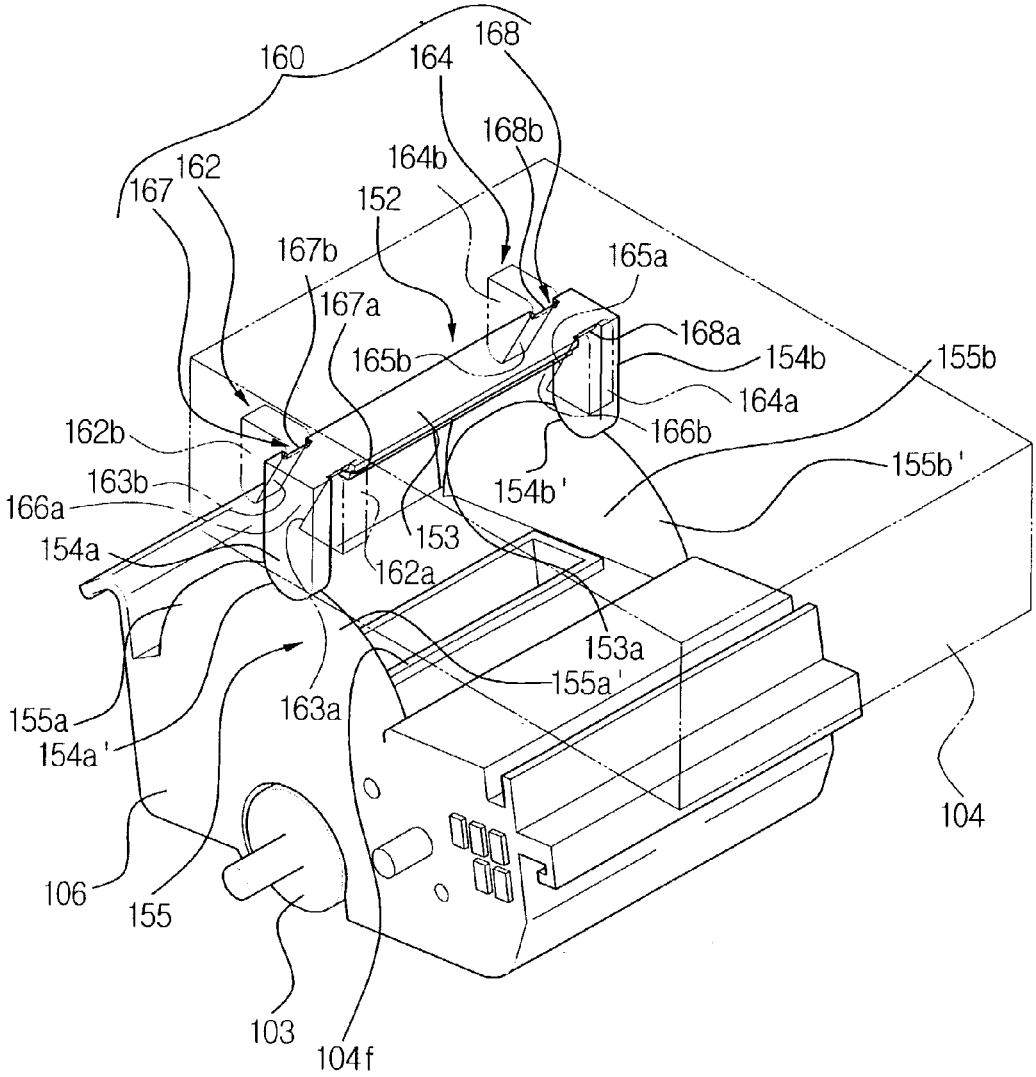
FIG. 4 is a perspective view of a laser beam isolation apparatus according to an embodiment of the present invention.

Referring to FIG. 4, and additionally to FIGS. 5A and 5B, the laser beam isolation apparatus 100 mounted relative to the developer unit 106 and the LSU 104 will be described.

The laser beam isolation apparatus 100 according to the present embodiment includes a blocking portion 152 formed on the LSU 104 to move between a blocking position (FIG. 5B) to block the passing hole 104*e* of the LSU 104 and an opening position (FIG. 5A) to open the passing hole 104*e*, a guide portion 160 mounted on the LSU 104 relative to the blocking portion 152 to move the blocking portion 152 between the blocking position and the opening position, and an operating portion 155 formed on the developer unit 106 and operating to raise the blocking portion 152 along the guide portion 160.

The blocking portion 152 includes an elongated passing hole blocking plate 153 shaped to completely cover the passing hole 104*e* of the LSU 104, and first and second projection levers 154*a*, 154*b* vertically protruding from both ends of the elongated passing hole blocking plate 153 through first and second passing holes 102 (the second passing hole is hidden in FIGS. 5A and 5B) towards the developer unit 106.

The passing hole 104*e* is shaped to have an inverted frusto-conical section, which can be easily sealed by the elongated passing hole blocking plate 153. A sealing projection 153*a* is formed on the lower side of the blocking plate 153 and is shaped to have the same section as that of the passing hole 104*e*, i.e., to have the inverted frusto-conical section so that the sealing projection 153*a* can be inserted therein, thus sealing the passing hole 104*e* when the elongated passing hole blocking plate 153 is placed on the passing hole 104*e*.

The first and the second projection levers 154*a*, 154*b* may be provided with first and second curved sides 154*a*′, 154*b*′ at the lower ends so as not to generate friction with upper ends of first and second operating projections 155*a*, 155*b* while being pushed by the first and second operating projections 155*a*, 155*b*.

The guide portion 160 includes first and second inclined sliders 167, 168 (FIG. 4) formed on the elongated passing hole blocking plate 153 at a proper interval, and first and second inclined slider guides 162, 164 having first and second inclined passages 166*a*, 166*b* to receive the first and second inclined sliders 167, 168 and guide the elongated passing hole blocking plate 153 to move at a predetermined slope.

The first inclined slider 167 includes first and second inclined sides 167*a*, 167*b* formed on one side of the elongated passing hole blocking plate 153 closer to the first projection lever 154*a* and formed opposite to each other in a width direction, and the second inclined slider 168 includes third and fourth inclined sides 168*a*, 168*b* formed on the other side of the elongated passing hole blocking plate 153 closer to the second projection lever 154*b* and formed opposite to each other in the width direction.

The first inclined slider guide 162 includes first and second guide plates 162*a*, 162*b*, each having first and second inclined guide faces 163*a*, 163*b*, to define the first inclined passage 166*a* that guides the first and second inclined sides 167*a*, 167*b* of the first inclined slider 167, and the second inclined slider guide 164 includes third and fourth guide plates 164*a*, 164*b* having third and fourth inclined guide faces 165*a*, 165*b* to define the second inclined passage 166*b* that guides the third and fourth inclined sides 168*a*, 168*b* of the second inclined slider 168.

Accordingly, in accordance with the ascending and descending of the elongated passing hole blocking plate 153, the first and second inclined sides 167*a*, 167*b* of the first inclined slider 167 are guided along the first and second inclined guide faces 163*a*, 163*b* of the first and second guide plates 162*a*, 162*b*, while the third and fourth inclined sides 168*a*, 168*b* of the second inclined slider 168 are guided along the third and fourth inclined guide faces 165*a*, 165*b* of the third and fourth guide plates 164*a*, 164*b*.

Alternatively, the first and the second slider guides 162, 164 may include a stopper (not shown) provided to the first and third guide plates 162*a*, 164*a* or to the second and fourth guide plates 162*b*, 164*b* so as to limit upward deviation of the elongated passing hole blocking plate 153 from the first and second inclined passages 166*a*, 166*b*. The stopper may be a protrusion supported on the first and third guide plates 162*a*, 164*a*, or on the second and the fourth guide plates 162*b*, 164*b* to be elastically protruded so that the first and the second inclined sliders 167, 168 of the elongated passing hole blocking plate 153 can be easily inserted in the inclined passages 166*a,b* during assembly.

The operating portion 155 includes the first and second operating projections 155*a*, 155*b* formed on the upper face of the developer unit 106 in correspondence with the first and the second projection levers 154*a*, 154*b* so as to, upon mounting of the developer unit 106, push the elongated passing hole blocking plate 153 of the blocking portion 152 upwards along the first and the second inclined sliders 167, 168 to thus position the first and the second projection levers 154*a*, 154*b* to the opening position. For a smooth contact with the first and second curved sides 154*a*′, 154*b*′ at the lower ends of the first and second projection levers 154*a*, 154*b*, the first and the second operating projections 155*a*, 155*b* have first and second corresponding curved sides 155*a*′, 155*b*′.

Accordingly, upon the mounting of the developer unit 106, the operating portion 155 pushes the first and second projection levers 154*a*, 154*b* upwards to thereby move the elongated passing hole blocking plate 153 of the blocking portion 152 to the opening position, while with the cover 120 being opened and the developer unit 106 being removed, the force upwardly pushing the first and the second projection levers 154*a*, 154*b* is eliminated to thus allow the elongated passing hole blocking plate 153 to move to the blocking position to block the passing hole 104*e* of the LSU 104.

The operation of the laser beam isolation apparatus 100 constructed as above according to the embodiment of the present invention will be described below with reference to FIG. 4 and additionally to FIGS. 5A and 5B.

Figure 5B:
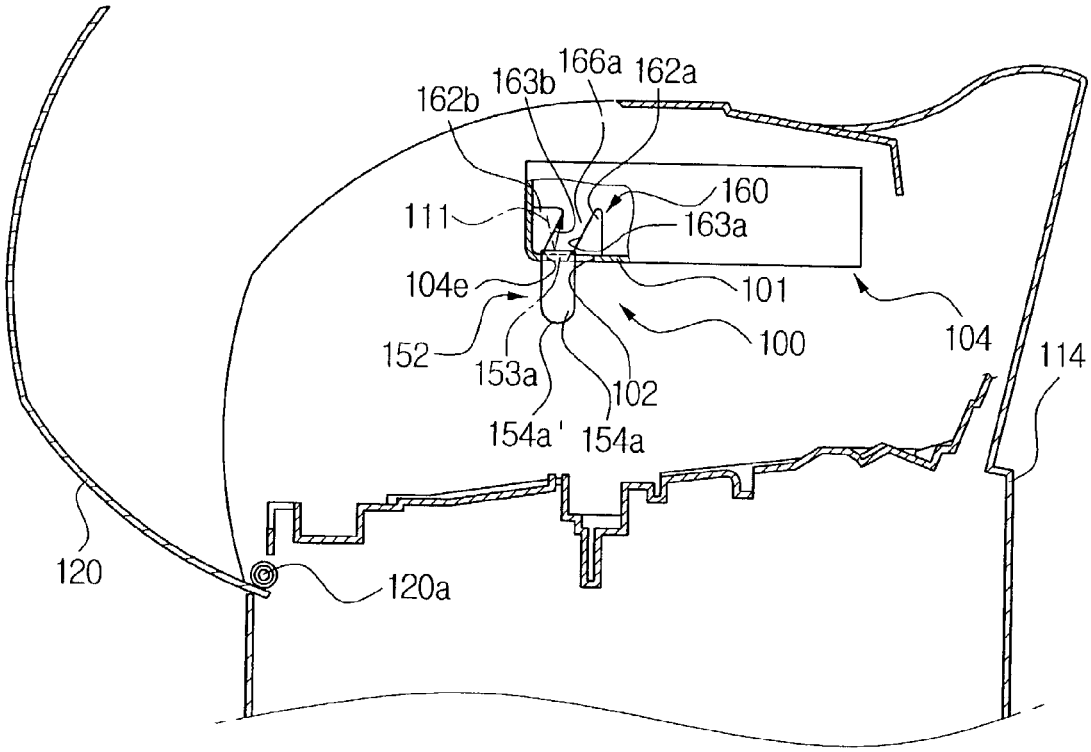

First, as shown in FIG. 5B, with the cover 120 of the laser printer being opened and the developer unit 106 being removed for purposes such as repair or replacement of the developer unit 106, the elongated passing hole blocking plate 153 of the blocking portion 152 is moved from the opening position supported by the first and the second operating projections 155*a*, 155*b* downwards by its own weight.

In such a situation, the first and the second inclined sides 167*a*, 167*b* of the first inclined slider 167 are guided downwards along the first and second inclined guide faces 163*a*, 163*b* of the first and second guide plates 162*a*, 162*b*, and the third and fourth inclined faces 168*a*, 168*b* of the second inclined slider 168 are guided downwards along the third and fourth inclined guide faces 165*a*, 165*b* of the third and the fourth guide plates 164*a*, 164*b*.

As the elongated passing hole blocking plate 153 is moved downward to the proximity of the passing hole 104*e* by its own weight, the sealing projection 153*a* at the lower side of the elongated passing hole blocking plate 153 is inserted in the passing hole 104*e* to thereby seal the same. Since the passing hole 104*e* is formed to have an inverted frusto-conical section, it is easily sealed by the sealing projection 153*a* which has the identical section.

Accordingly, when the cover 120 is opened and then the developer unit 106 is removed, or when the cover 120 is opened with the developer unit 106 having already been removed, the laser beam 111 which may possibly be emitted from the laser diode due to abnormal operation of the laser beam blocking switch, is not leaked to the outside of the LSU 104, but is instead reflected to the inside of the LSU 104 due to the sealing projection 153*a* that seals the passing hole 104*e*.

Further, since the sealing projection 153*a* seals the passing hole 104*e* as the elongated passing hole blocking plate 153 is moved downward by its own weight, entrance of foreign substances such as dust into the LSU 104 through the passing hole 104*e* is prevented.

The first and second operating projections 155*a*, 155*b* of the operating portion 155 formed on the upper side of the developer unit 106 raise the first and second projection levers 154*a*, 154*b* upon re-mounting of the developer unit 106. Accordingly, the elongated passing hole blocking plate 153 of the blocking portion 152, which was moved down to the blocking position by its own weight, moves upwards.

The first and second inclined sliders 167, 168 of the guide portion 160 are moved upward while being guided along the first and the second inclined passages 166*a*, 166*b* of the first, the second, the third and the fourth guide plates 162*a*, 162*b*, 164*a*, 164*b*.

As the elongated passing hole blocking plate 153 moves upwards to the opening position that completely opens the passing hole 104*e*, as shown in FIG. 5A, the laser beam 111 from the laser diode of the LSU 104 is irradiated on the surface of the photoreceptor drum 103 through the passing hole 104*e*.

Then as the developer unit 106 is mounted, positioning the elongated passing hole blocking plate 153 in the full opened position, repair or replacement of the developer unit 106 is completed by closing the cover 120.

As described above, with the laser beam isolation apparatus according to the embodiment of the present invention, when either opening the cover and removing the developer unit, or opening the cover with the developer unit having already been removed, a laser beam from the laser diode is prevented from being emitted to the outside even when the laser diode operates due to abnormal operation of the laser beam blocking switch. Also, entrance of foreign substances into the LSU through the passing hole can be prevented.

Further, since the blocking portion of the laser beam isolation apparatus according to the embodiment of the present invention is moved to the blocking position by its own weight, there is no requirement for separate parts such as elastic springs. As a result, manufacturing costs are reduced, while the structure of the apparatus is simplified.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A laser beam isolation apparatus of a laser printer having a housing having a cover, a developer unit mounted in the housing and having a photoreceptor body to form an image by using an electric property of a surface thereof, a laser scanning unit mounted in the housing and comprising a light source to irradiate a laser beam onto the photoreceptor, and a passing hole through which the laser beam is emitted from the light source toward the surface of the photoreceptor body, comprising:

a blocking portion formed on the laser scanning unit to be moved between a blocking position and an opening position, the blocking position to block the passing hole and the opening position to open the passing hole; and an operating portion formed on the developer unit, and to slide the blocking portion from the blocking position to the opening position.

2. A laser beam isolation apparatus of a laser printer having a housing having a cover, a developer unit mounted in the housing and having a photoreceptor body to form an image by using an electric property of a surface thereof, a laser scanning unit mounted in the housing and comprising a light source to irradiate a laser beam onto the photoreceptor, and a passing hole through which the laser beam is emitted from the light source toward the surface of the photoreceptor body, comprising:

a blocking portion formed on the laser scanning unit to be moved between a blocking position and an opening position, the blocking position to block the passing hole and the opening position to open the passing hole;

an operating portion formed on the developer unit, and operated to move the blocking portion in a first direction; and a guide portion mounted in the laser scanning unit to guide the blocking portion to move between the blocking position and the opening position.

3. The laser beam isolation apparatus of claim 2, wherein the blocking portion comprises:

an elongated passing hole blocking plate to completely seal the passing hole of the laser scanning unit when the blocking portion is in the blocking position; and a projection lever protruding from the elongated passing hole blocking plate.

4. The laser beam isolation apparatus of claim 3, wherein the guide portion comprises:

an inclined slider formed on the elongated passing hole blocking plate; and an inclined slider guide having an inclined passage to receive the inclined slider therein and guide the elongated passing hole blocking plate to move along a predetermined slope thereof.

5. The laser beam isolation apparatus of claim 4, wherein the inclined slider guide comprises a stopper to limit a movement of the elongated passing hole blocking plate within a predetermined range thereby preventing a deviation of the elongated passing hole blocking plate from the inclined passage.

6. The laser beam isolation apparatus of claim 4, wherein the operating portion comprises an operating projection formed on the developer unit to correspond to the projection lever to push the projection lever opposite to the first direction and thus move the blocking portion to the opening position upon mounting the developer unit.

7. The laser beam isolation apparatus of claim 6, wherein the projection lever and the operating projection include a rounded contact surface for smooth contact between the projection lever and the operating projection.

8. The laser beam isolation apparatus of claim 2, wherein at least one of the operating portion and the blocking portion have a semi-circular shape.

9. An apparatus comprising:

a scan unit to emit a laser through a hole formed therein, including a blocking portion to selectively block the laser, wherein the blocking portion comprises:

a plate to block the hole, and a projection lever extending from the plate; and a developing unit to develop an image from the emitted laser and including a moving portion to selectively move the blocking portion to block the laser, wherein the laser is selectively blocked to contain the laser within the scan unit, the blocking portion is selectively moved between a first position to block the laser, and a second position to allow the laser to pass through the hole, the developing unit is selectively removable, and the blocking portion blocks the laser when the developing unit is removed.

10. The apparatus of claim 9, wherein the hole has a frusto-conical shape, and the blocking portion comprises a sealing projection having a frusto-conical shape to be inserted into the hole.

11. The apparatus of claim 13, further comprising a guide mounted in the scan unit to guide the blocking portion between the first and second positions.

12. The apparatus of claim 11, wherein the guide comprises:

a slider formed on the plate; and a slider guide to receive and guide the slider.

13. The apparatus of claim 12, wherein the moving portion comprises a projection extending from the developing unit.

14. The apparatus of claim 13, wherein the projection corresponds to the projection lever to thereby push the blocking portion along the slider to the second position when the developing unit is installed.

15. The apparatus of claim 14, wherein the blocking portion moves to the first position by its own weight when the developing unit is removed.

16. An apparatus comprising:

a scan unit to emit a laser, including a blocking portion to selectively block the laser; and a developing unit to develop an image from the emitted laser, wherein the developing unit is removable and the blocking portion moves to a position to block the laser by its own weight when the developing unit is removed.

17. An apparatus comprising:

a scan unit to emit a laser, including a blocking portion to slide to selectively block the laser; and a guide to guide the blocking portion.

18. An apparatus comprising:

a scan unit to emit a laser, including a blocking portion to selectively block the laser; and a guide to guide the blocking portion, wherein the guide comprises:

an inclined side; and an inclined guide face formed on the blocking portion to receive the inclined side.

* * * * *

UNITED STATES PATENT AND TRADEMARK OFFICE

CERTIFICATE OF CORRECTION

PATENT NO. : 7,002,615 B2
APPLICATION NO. : 10/430256
DATED : February 21, 2006
INVENTOR(S) : Hyeong-seog Shim It is certified that error appears in the above-identified patent and that said Letters Patent is hereby corrected as shown below:

On the Title Page, Column 1, (75) Inventor, replace "Hyeong-seong" with --Hyeong-seog--, therefor.

Signed and Sealed this

Fifteenth Day of August, 2006

JON W. DUDAS
*Director of the United States Patent and Trademark Office*